US010544529B2

(12) United States Patent
Barea

(10) Patent No.: US 10,544,529 B2
(45) Date of Patent: Jan. 28, 2020

(54) METHOD AND SYSTEM FOR MANAGING AND CONTROLLING THE FEEDING OF AT LEAST ONE THREAD TO A TEXTILE MACHINE AS A FUNCTION OF THE OPERATING STEP OF THE LATTER

(71) Applicant: BTSR INTERNATIONAL S.P.A., Olgiate Olona (VA) (IT)

(72) Inventor: Tiziano Barea, Busto Arsizio (IT)

(73) Assignee: BTSR INTERNATIONAL S.P.A, Olgiate Olona (VA) (IT)

( * ) Notice: Subject to any disclaimer, the term of this patent is extended or adjusted under 35 U.S.C. 154(b) by 259 days.

(21) Appl. No.: 15/557,219

(22) PCT Filed: Mar. 10, 2016

(86) PCT No.: PCT/IB2016/051371
§ 371 (c)(1),
(2) Date: Sep. 11, 2017

(87) PCT Pub. No.: WO2016/142901
PCT Pub. Date: Sep. 15, 2016

(65) Prior Publication Data

US 2018/0038023 A1 Feb. 8, 2018

(30) Foreign Application Priority Data

Mar. 12, 2015 (IT) ..... MI2015A0374

(51) Int. Cl.
*D04B 15/48* (2006.01)
*D04B 15/99* (2006.01)
*D04B 35/12* (2006.01)

(52) U.S. Cl.
CPC ..... *D04B 15/48* (2013.01); *D04B 15/99* (2013.01); *D04B 35/12* (2013.01)

(58) Field of Classification Search
CPC ..... D04B 15/38; D04B 15/44; D04B 15/484; D04B 15/486; D04B 15/99; D04B 35/12; D04B 15/48
(Continued)

(56) References Cited

U.S. PATENT DOCUMENTS 5,566,574 A * 10/1996 Tiziano ..... B65H 59/24 73/160
5,838,570 A * 11/1998 Barea ..... B65H 61/00 700/143
(Continued)

FOREIGN PATENT DOCUMENTS

EP 0619261 A1 10/1994
EP 2067886 A1 6/2009
WO 2013114174 A1 8/2013

OTHER PUBLICATIONS

International Search Report and Written Opinion dated May 23, 2016 for PCT/IB2016/051371 to BTSR International S.P.A. filed Mar. 10, 2016.

*Primary Examiner* — Danny Worrell
(74) *Attorney, Agent, or Firm* — Vorys, Sater, Seymour and Pease LLP

(57) ABSTRACT

Method and system for managing and controlling feeding of at least one thread to a textile machine as a function of the machine operating step in product production or thread processing, such production or processing providing for a succession of steps corresponding to obtaining product parts or treating thread. The thread fed to the machine by a feeder at constant tension and/or speed and/or controlled by a sensor which monitors sliding or inherent characteristic thereof such as tension, speed, diameter, quantity and color. The sensor and/or feeder controlled by a setting controller. The setting controller receiving synchronization signals from the machine and detecting—according to the latter—
(Continued)

the operating steps and thus product or production status. The operation setting programmed as a function of operating steps. The machine generates a unique synchronization signal, for each operating step, independently from step length.

19 Claims, 2 Drawing Sheets

(58) Field of Classification Search
USPC ..... 700/130, 141; 66/146
See application file for complete search history.

(56) References Cited

U.S. PATENT DOCUMENTS

| | | | | |
|---|---|---|---|---|
| 6,550,285 | B2 * | 4/2003 | Nishitani | D04B 15/48 66/125 R |
| 7,896,282 | B2 * | 3/2011 | Barea | B65H 51/30 242/418 |
| 8,170,710 | B2 * | 5/2012 | Barea | D04B 35/12 700/141 |
| 8,175,740 | B2 * | 5/2012 | Lamprillo | B65H 59/06 700/130 |
| 9,062,397 | B2 * | 6/2015 | Barea | D04B 15/99 |
| 2005/0173579 | A1 * | 8/2005 | Barea | D04B 15/50 242/365.7 |
| 2008/0256983 | A1 | 10/2008 | Weber | |

* cited by examiner

| A<br>MACHINE PROGRAM | | B<br>OPERATING PROGRAM<br>(MANAGING OPERATING STEPS) | | | |
|---|---|---|---|---|---|
| AREA | MACHINE CODE | FEEDER_1 | FEEDER_2 | SENSOR_1 | SENSOR_2 |
| ZERO | 0 | 2.0 g operating tension | 3.0 g operating tension | Sensor disabled | Sensor disabled |
| CUFF | 1 | 10.0 g operating tension<br>To be attained within 10 rotations of the cylinder<br>BROKEN THREAD ON | 3.0 g operating tension<br>BROKEN THREAD OFF | Sensitivity 4<br>THREAD CONTROL ON | Sensitivity 4<br>THREAD CONTROL OFF |
| LEG | 2 | 5.0 g operating tension<br>To be attained within 30 rotations of the cylinder<br>BROKEN THREAD ON | 4.0 g operating tension<br>To be attained within 500 MS<br>BROKEN THREAD ON | Sensitivity 6<br>THREAD CONTROL ON | Sensitivity 5<br>THREAD CONTROL ON |
| HEEL | 3 | 5.0 g operating tension<br>To be attained within 5 rotations of the cylinder<br>BROKEN THREAD ON | 5.0 g operating tension<br>To be attained within 200 MS<br>BROKEN THREAD ON | Sensitivity 6<br>THREAD CONTROL ON | Sensitivity 5<br>THREAD CONTROL ON |
| FOOT | 4 | 6.0 g operating tension<br>To be attained within 3 rotations of the cylinder<br>BROKEN THREAD ON | 6.0 g operating tension<br>To be attained within 300 MS<br>BROKEN THREAD ON | Sensitivity 4<br>THREAD CONTROL ON | Sensitivity 5<br>THREAD CONTROL ON |
| TIP | 5 | 4.0 g operating tension<br>To be attained within 3 rotations of the cylinder<br>BROKEN THREAD ON | 4.0 g operating tension<br>To be attained within 200 MS<br>BROKEN THREAD ON | Sensitivity 3<br>THREAD CONTROL OFF | Sensitivity 4<br>THREAD CONTROL ON |

*Fig. 2*

METHOD AND SYSTEM FOR MANAGING AND CONTROLLING THE FEEDING OF AT LEAST ONE THREAD TO A TEXTILE MACHINE AS A FUNCTION OF THE OPERATING STEP OF THE LATTER

CROSS-REFERENCE TO RELATED APPLICATIONS

This is a § 371 National Stage Application of International Application No. PCT/IB2016/051371 filed on Mar. 10, 2016, claiming the priority of Italian Patent Application No. MI2015A000374 filed on Mar. 12, 2015.

FIELD OF THE INVENTION

A method and system for managing and controlling a thread or a plurality of threads, fed by devices with constant tension and/or speed or controlled by sensors adapted to verify the state of sliding or the state of any of the characteristic properties thereof such as the tension, speed, diameter, quantity, color or the like according to the preamble of the corresponding independent claims, form an object of the present invention.

BACKGROUND OF THE INVENTION

In particular, but not limitedly, the invention regards the management of one or more feeders at a constant tension and/or speed and/or one or more control sensors for obtaining a product, which is obtained by means of a procedure generally divided into different and subsequent production steps, such as a stocking or any other product, a garment or similar textile product. Such products have portions (or "macro-areas," such as the heel or the leg of a stocking) which are processed in specific and distinct operating phases during the production thereof. The invention also regards the management of a feeder or a sensor for controlling only one thread subjected to a particular treatment or processing (such as for example texturizing, winding, twisting, plying or the like).

Devices capable of feeding a thread to a textile machine maintaining the tension and/or speed of the thread constant and uniformed at a reference value called "setpoint" are known to the man skilled in the art. For example, in a machine like that for knitwear or production of stockings or production of ribbons, a plurality of threads is sent to the textile machine and such threads are fed by corresponding feeders of the aforementioned type.

During the production of numerous products (for example, but not limitedly, medical stockings, pantyhose, ribbons), there arises an ever-increasing need for modifying the setpoint value (regarding the tension and/or speed) of said feeder with the aim of obtaining, on a specific finished garment, a particular effect, as it occurs for example in graduated compression stockings or parts of the product (such as a stocking) having macro-areas with different characteristics (such as the heel or leg) or product parts with decorations (such as scarf or sweater).

It is also known that said setpoint value may even vary during the processing of only one thread or during one of the many processes required for producing the thread (such as twisting, winding, yarn clearing, intermingling or the like). For example, in the winding of a dyeing yarn it is important to maintain the winder loose and thus the tension with which the thread is wound should reduce as a function of the diameter thereof; or it is important to have a lower operating tension on the automatic doffing machine during the doffing step so as to facilitate the automatic winder change system.

In addition, it is known that the producers (or those processing the threads) have the need to manage the setpoint of the feeders as a function of the particular product meant to be obtained and thus the operating state of the textile machine or the particular operating step of the same in which a specific part of the product or a macro-area thereof is obtained. With particular, but not limited example to the stocking manufacturing industry, there arises the need of defining—for each macro-area of the stocking such as for example the cuff, leg, ankle, heel, foot, tip, (or any other product with parts obtained in a different manner such as for example swimming costumes, technical garments, ribbons with variable width, or the like)—the feeding tension and/or speed for each thread used for the implementation of the operating step during which such macro-area is obtained, but also only for the implementation of each operating step to obtain a specific part of a specific product being processed. There also arises the need to define the method (speed/ramp) through which one or the specific feeder device is required to pass from one setpoint to the other upon the variation of the production of various product macro-areas and/or the specific parts thereof.

In the present document, the term "macro-area" is used to indicate a portion of the product (such as for example the heel, leg or ankle in the stockings manufacturing industry). As regards the sensors for controlling the presence of the thread or controlling the quality of the latter, the need of activating the intervention only in some product production steps is known, i.e. during specific steps in which specific product macro-areas are obtained; in the case of stockings, for example, this applies for the obtainment of the leg or heel or any other portion of the stocking, or varying the operating and control parameters thereof as a function of the production steps of the various product macro-areas.

Various possible solutions, valid both in case of feeders at constant tension and feeders at constant speed, to this problem are currently known; thus, though the following examples refer to feeders at constant tension, they also apply in case of feeders at constant speed.

In a first known solution (EP0619261), many feeder devices provide for one or more digital inputs through which the modifications on the setpoint tension (the case of small or medium diameter circular machines mentions increases—INC—and decreases—DEC—or "graduations") can be managed. In this case, the operator utilizes one or more digital outfeeds, normally present in the textile machines and freely programmable, with the aim of obtaining the specific desired products; such operator utilizes digital signals for modifying the reference value of each device in the operating program of the machine (the case of small and medium diameter circular machines mentions a "chain" machine, i.e. an assembly of commands and control that define the machine program).

However, such solution reveals numerous drawbacks. For example, the aforementioned known solution provides for the use of an increase digital outfeed and decrease digital outfeed by the machine for every device or groups of feeder devices associated thereto to allow the operator to program the setpoint of each device independently; thus, the solution requires a high number of programmable outfeeds of the machine, and this is not always possible. In addition, this solution implies that any modification, for example to the tension at which the thread is to be controlled during a particular process, implies the modification on the program of the machine to manage such programmable outfeeds in a different manner. For example, passing from a 2.0 grams tension to a 5.0 grams tension, with the increase/decrease resolution equivalent to 0.1 grams, shall require 30 increase pulses and thus at least 30 machine program lines; obviously, return to the initial 2.0 grams tension shall require 30 decrease pulses and other 30 lines of the machine program.

However, it should be observed that "old" textile machines and modern textile machines alike, are not always provided with freely programmable digital outfeeds; this for example creates problems during the "retrofit" step of the machines already available in the market even in the light of the fact that different wiring shall be required depending on the machine.

Another known solution is based on the fact that most feeders instead provide for a serial communication that is interfaced with the control unit, usually a microprocessor, of the textile machine, through which the reference setpoint value can be programmed to obtain various product macro-areas. Obviously, this solution is definitely more flexible with respect to the preceding one but it still reveals the following drawbacks:

the textile machine should already be predisposed for the serial management of said feeders. Thus, such solution is not applicable to all types of machines available in the market, in particular in case of application on machines of the old type;

such solution forces thread feeder manufacturers to closely collaborate with various manufacturers of textile machines, given that every device obviously has a specific communication protocol and depends on the communication standard required of the control unit of the textile machine;

thus, even this solution requires modifying the machine program any time one wants to modify the tension of a device in a particular area of the product.

Lastly, in case of improvements on the feeder device, for example increasing the resolution of the system or addition of new control functions, the new functions cannot be implemented on previously operating machines without requiring the intervention of the manufacturer of the latter to intervene on the software for managing the feeders.

EP2067886 reveals a system having the object of guaranteeing the quality of a finished textile product controlling the consumption of LFA (absorbed yarn length) of each feeder present on the textile machine, measuring the value thereof and thus making it coincide with the preset value, learnt or set by acting on the setting tension (setpoint) of the feeder. Basically, a control algorithm modifies the value of the operating tension of each feeder to keep the LFA value constant.

In order to operate in this manner, the known system provides for interfacing with the machine, though very simple, made up of a physical or virtual start signal (ZERO signal) and a periodical signal of the process progress state. In its simplest version, the system executes an LFA control and thus a change of tension of each feeder on each manufactured garment (end of cycle); in a more complex version instead, the control may occur at various points of the garment using the combination of two synchronization signals (end of cycle plus periodical signal) to define the processing point in a unique manner.

Thus, the system provides for a table in which the overall LFA values (set or learnt) at every instant of the production cycle of each feeder are recorded. These values are then subsequently used as reference for deciding how to modify the operating tension thereof as a function of the measured quantity.

US2008/256983 provides for a complex and direct synchronization of a plurality of thread feeders using a textile machine. The priority document has the object of providing a system capable of constantly communicating with the textile machine to receive—therefrom, information regarding the enabling and disabling of the single feeders, which would not be capable of feeding the thread to the textile machine in an independent and autonomous manner without these enabling and disabling signals. Such control system requires an absolute synchronization with the textile machine.

In this prior art text, the need for programming corrections regarding the feeders management signals with the aim of adapting the enabling and disabling signal thereof to make the system functional to the variation of the various types of thread for example, is mentioned on several occasions. The text describes advanced, lag or start signals at different feed speeds with respect to the actual ones with the aim of avoiding the stress of the thread, for example, during the start or stop steps. Thus, the feeders described in US 2008/256983 reveal their incapability to operate autonomously and thus the complexity of the system for managing these feeders upon the variation of the thread (for example yarn with different elasticity), upon the variation of the distance thereof from the point of insertion of the thread into the textile machine and upon variation of the types of machine.

US2008/256983 further describes the use of a tension sensor for activating and deactivating the single feeder devices; this with the aim obtaining a first reference map for enabling and disabling the feeders to be utilized subsequently, supplementing the data with the previously described advance and lag values.

Such known system reveals the considerable drawback lying in the fact that it has a learning/control step, during which the system is not under control. Such criticality is obviously even more limiting with reference to applications on large diameter circular machines (knitwear machine) wherein such step can be extremely long (reaching 30 minutes sometimes).

WO2013114174, on behalf of the applicant and to which the preambles of the independent claims of present document refer, describes a method and system for managing the feeding of a plurality of threads with constant tension and/or speed to a textile machine of the circular type, loom or yarn preparation. The threads are fed to said machine by a corresponding plurality of feeder devices; setting means adapted to set the operation thereof are connected thereto. The control means receive a synchronization signal—from the machine—regarding the start/end of the complete product processing cycle and a process progress state synchronization signal which, for example in the case of a circular machine, corresponds to the implementation of a complete or partial rotation (for example 4 pulses per rotation) of the cylinder of such machine. According to these signals, the setting means detect every operating step of a production cycle or the process progress state of a product or a production process. In the case of a circular loom, in particular, the aforementioned control means receive at least signals regarding the completion of a complete or partial rotation of the cylinder of such loom and according to the plurality of such signals, the production progress state of the product or the part of the product in question is established in an absolute and definite manner.

This prior art document provides for dividing such complete production cycle into different steps by means of corresponding synchronism signals (PRX) generated, for example in the case of a circular machine, by executing a complete or partial rotation of the relative cylinder. The control means intervene on each feeder device as a function of said steps (process progress state) or said synchronization signals so that such device feeds and/or controls the respective thread with predefined and peculiar tension and/or speed of each of such steps and thus each part of the product meant to be obtained. As a matter of fact, values of at least one characteristic of the thread fed by each feeder device selected from at least the tension, speed and presence of thread are set for each product production cycle corresponding to obtaining each part of the latter.

Such control means program such values of the aforementioned characteristics as a function of said steps whose actuation by the machine is defined and detected through the aforementioned synchronization signals continuously generated by said machine and received by said control means at each progress of the process.

WO2013114174 provides for that the values of each characteristic of the fed thread be recorded in a table in a memory of the control means so that each part of the produced product (defined by a synchronization signal PRX), for each complete or partial rotation of the cylindrical member of the machine and for every feeder device, there be provided a set data which can be used for comparing the corresponding current value detected by the interface, driving and control unit of the feeder device.

In the aforementioned table, the finished product is defined by a plurality of said signals having a series of numbers from 1 to N, where the signal PRX=N corresponds to the last part of the finished product or at the end of the production of the product. Thus, the Table is made up of as many production steps as the synchronization signals PRX; said steps define the lines of the aforementioned Table thus corresponding to different product production stages, i.e. the production of each part of the latter (precisely connected to each rotation of the cylinder, in the case of the circular textile machine, as indicated in page 9, lines 5-9 of WO2013/114174).

An example of the aforementioned Table is indicated below.

| PRX | AREA | FEEDER TENSION 1 | FEEDER TENSION 2 |
|---|---|---|---|
| 1 | CUFF | 8.0 | 3.0 |
| 2 | | 8.0 | 3.0 |
| | | 8.0 | 3.0 |
| 9 | | 8.0 | 3.0 |
| 10 | | 8.0 | 3.0 |
| 11 | LEG | 6.0 | 4.0 |
| 12 | | 6.0 | 4.0 |
| | | 6.0 | 4.0 |
| | | 6.0 | 4.0 |
| | | 6.0 | 4.0 |
| 49 | | 6.0 | 4.0 |
| 50 | | 6.0 | 4.0 |
| 51 | HEEL | 4.0 | 3.0 |
| | | 4.0 | 3.0 |
| 59 | | 4.0 | 3.0 |
| 60 | | 4.0 | 3.0 |
| 61 | FOOT | 6.0 | 4.0 |
| 62 | | 6.0 | 4.0 |
| | | 6.0 | 4.0 |
| | | 6.0 | 4.0 |
| 69 | | 6.0 | 4.0 |
| 70 | | 6.0 | 4.0 |

-continued

| PRX | AREA | FEEDER TENSION 1 | FEEDER TENSION 2 |
|---|---|---|---|
| 71 | TIP | 4.0 | 3.0 |
| | | 4.0 | 3.0 |
| | | 4.0 | 3.0 |
| 75 | | 4.0 | 3.0 |
| 76 | | 4.0 | 3.0 |

The object of the prior art document in question is to provide a system that allows standardizing the production of a garment, by creating a table for example containing the trend of the setpoint tension of one or more feeders during the obtainment of each single part of the garment as a function of the process progress state. Thus, such tension corresponds to each single synchronization signal (or at least to a group of such signals continuously received from the control means and each necessarily corresponding to a production of a single part of the product).

In the prior art case in question, the tension to be used is the parameter that allows obtaining the garment with the desired characteristics. For example, in a graduated compression medical stocking, the table contains tension values to be used for obtaining the desired compression in the various parts or in the various points of the stocking (the compression potentially being different in the macro-area of the stocking defined by the ankle with respect to the compression present in the macro-area defined by the leg . . . ).

In addition, given that the interfacing with the machine is very simple and it does not absolutely depend on the model of the machine, manufacturer or technical characteristics thereof, the prior art document actually proposes an abstraction method that allows creating an article that is easy to transfer from one machine to the other. Besides not depending on the type of machine, such system also does not depend on the model of feeders used.

However, WO2013114174 provides for that each synchronization signal (for example generated by the machine for producing stockings at each rotation of the cylinder thereof) be used for controlling feeders or sensors. Thus, this subordinates such control to the actual obtainment of the synchronization signals and the plurality of such signals which corresponds to the length of each single part of the manufactured product or the length of each single operating step corresponding to said single part of the product. For example in the case of production of stockings of various sizes, different rotations of the cylinder have to be set for the same parts of the stockings as a function of the sizes thereof, said different settings leading to the production of different desired stockings. Thus, there arises the need for different programs for the same stocking hence obviously implying greater management complexity and probability of error by the operator.

For example, when producing the same type of stocking, but of different sizes, thus in which the number of synchronization signal PRX for each area is variable (for example, with reference to the Table above, 60 PRX are associated with the LEG instead of 40 PRX), the user is forced to modify the Table and thus always has to accurately know the PRX number associated to each area.

Thus, the invention of WO2013114174 still reveals a drawback in the application thereof in that, though at a lower extent, such application is always bound to the knowledge of the accurate duration (number of synchronization pulses PRX) of the single portions (macro-areas) of the product. In addition, in the solution provided for by WO2013/114174, the change of the macro-area of the product is associated to the PRX number (for example CUFF→LEG, associated to the passage of PRX from 10 to 11) and thus it varies as a function of the size; this necessarily requires different Tables for every size and the operator has to know and program the PRX range for each size (example SIZE_1 PRX from 10 to 11, SIZE 2 PRX 12 to 13, . . . ). Besides programming different Tables for every size, the operator also has to load different programs upon the variation of the size during the processing step. In addition, besides the discomfort and risk of error in loading erroneous programs, the implementation of WO2013/114174 implies considerably higher occupation of the memory of the control means.

SUMMARY OF THE INVENTION

An object of the present invention is to provide an improved system and method for managing the feeding of a plurality of threads with constant tension and/or speed to a textile machine.

In particular, an object of the present invention is to provide a method and system of the aforementioned type that allows a simpler management of each feeder both in terms of programming and interfacing with the textile machine, if compared with the prior art.

In particular, an object of the present invention is to provide a method and system of the aforementioned type in which the control of the single feeders and/or single sensors occurs independently from the obtainment of the synchronization signals PRX in each single macro-area of the product, the signals allowing—in the prior art—to know the length of the single operating steps or single parts of the product; this independently from the length of the single macro-areas of the manufactured product, though maintaining such control differentiated for every single operating step or for every single part of each product macro-area.

Another object is to provide a method and system of the aforementioned type that allows a flexible management (or different programming for each feeder device) without requiring the use of resources or programmable outfeeds of the machine.

Another object is to provide a system and method of the aforementioned type that allows the management of feeder devices on any textile machine, even one not predisposed for such function.

A further object is to provide a method of the aforementioned type capable of allowing generating the operating program of the machine or "chain program" in a simple and intuitive manner for the operator without the latter having to worry about the methods of intervention on the feeders, but only the result on the finished product.

Another object is to provide a system of the aforementioned type capable of allowing the feeders manufacturer to design them independently from the textile machines on which such devices shall be required to operate thus allowing the manufacturer to continue developing and improving the product or product family thereof, without having to worry about the possible difficulty of being compatible with the textile machines, already operative or inoperative, to which such feeders shall be connected, given that no predisposition in said machines is required, except for the generation of at least one unique synchronism signal at the beginning of the controlled operating step. As a matter of fact, such availability is already provided for in the machine in that it could correspond to the activation of a thread guide, a solenoid valve or any other device of the machine or any other function thereof.

A further object is to provide a system and method of the aforementioned type capable of allowing obtaining products with "fancy patterns" in a simple manner for the operator, where the expression fancy patterns is used to indicate a portion (repetitive or random) in the macro-area being processed for example in which the operating tension or speed (i.e. the setpoint) varies repeatedly or randomly (for example 2.0→2.5→1.5→2.5→2.0 or random sequence as regards the tension).

Another object is to provide a method and system of the aforementioned type that can be standardized so that they can be potentially utilized with any textile machine model, of any brand, model or year of manufacture.

These and other objects which shall be more apparent to the man skilled in the art are attained by a system and method according to the attached claims.

BRIEF DESCRIPTION OF THE DRAWING

For a better understanding of the present invention, the following drawings are attached hereto, by way of non-limiting example, wherein:

FIG. 2 shows a table indicating a possible operating mode of the system according to the invention.

DETAILED DESCRIPTION OF THE PREFERRED EMBODIMENTS

Figure 1:
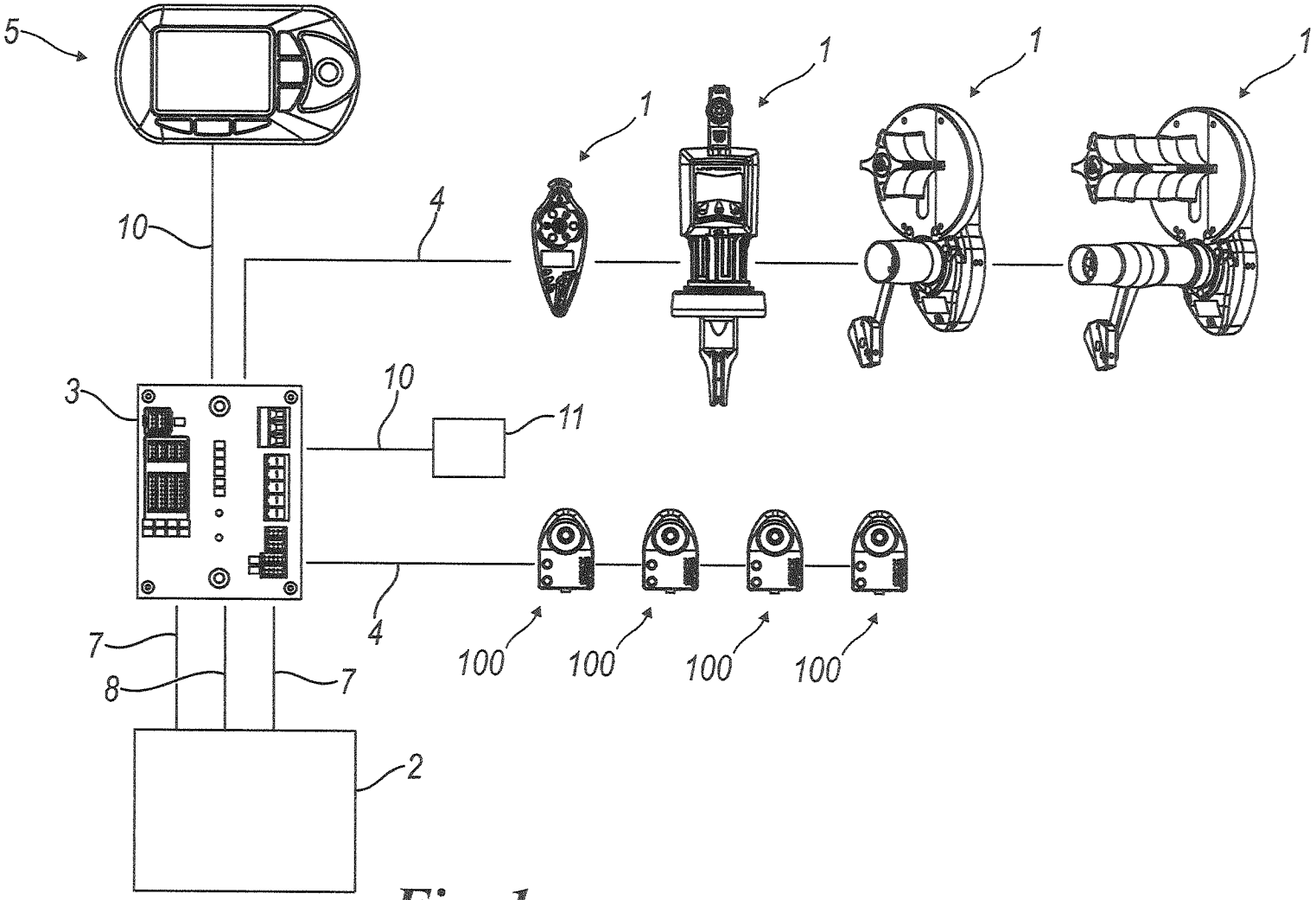
FIG. 1 shows a diagram of a system obtained according to the invention.

With reference to the aforementioned FIG. 1, it shows various devices 1 for feeding the threads (not shown) to a textile machine 2, such devices possibly being identical or different from each other. FIG. 1 also shows sensors 100 adapted to control at least one characteristic of each fed thread such as the tension, speed, diameter, quantity and color thereof or the like.

The textile machine is of the type adapted to manufacture a product. However, the invention can also be applied to machines for preparing the yarn where each single thread is subjected to an operating cycle (for example, twisting, texturizing, plying, intertwining) which still comprises operating "areas" or operating steps for obtaining product macro-areas or single complete treatments of a plurality of treatments to which the thread is subjected, distinct from each other, in the production cycle: for example, for the production of a spool, the production areas or steps could be binding, winding with layers having different operating tensions, doffing or repetitive or random fancy patterns obtained during the production of the spool.

All the devices 1 and 100 in FIG. 1 are connected to the control and interface unit 3, preferably of the microprocessor type. Such interface unit 3 may have or be connected through a connection 10 (of every type, electrical or serial), to the a display 11 and/or a keypad 5 through which an operator can enter or select different operating modes of the unit 3 and programming the operation of each device (feeder or sensor) connected to the latter.

The control and interface unit 3 is adapted to program and manage the devices as a function of the various operating modes of the machine. As mentioned, such devices can be of the same type or type different from each other (feeder of the thread at constant tension, feeder of the thread at constant speed, sliding control sensors, sensors for controlling the quality of the thread etc.) The management and programming of said devices preferably occurs through a serial line 4 which is connected to the unit 3, so as to simplify and thus reduce the system wiring costs, in particular when the number of devices 1 and 100 is particularly high (such as for example in case of medium and large diameter circular machines).

The invention (method and system) is based on the fact that in almost all textile production processes, for example in small and medium diameter circular machines, the production process can be divided into a series of repetitive production cycles, where a production process corresponds to the production of a single garment (for example a stocking).

A plurality of operating steps for obtaining complete parts with macro-areas of the product, for example, in the case of a stocking i.e. the heel, leg, foot, etc., can be identified in every production cycle. Thus, production sub-processes adapted to obtain single "parts" of each macro-area or single "sections" of the product which, together with similar and consecutive sections, define the latter can be identified in each of said operating steps that lead to obtaining a product macro-area. In the light of this consideration, it is provided for that the unit 3 operates receiving—from the textile machine 2, through electrical or serial connection lines 7 and 8—at least synchronization signal that uniquely identifies each operating step adapted to define at least one product macro-area, this always allowing such unit 3 to absolutely and uniquely identify the process progress state of the textile machine.

Such synchronization signal may be obtained through any electrical signal, a frequency modulated signal, an amplitude modulated signal, a variable duty cycle signal, a pulse sequence, a logic signal or an analogue signal. However, it is such to identify the start (or end) of a specific operating step of the machine (area) to which said signal is correlated so as to define the start (or end) of the production step of a macro-area of the product.

The machine 2 is thus predisposed to generate, through a usual programmable control unit thereof in which the steps for processing a product are memorized, said synchronism signal each time a single macro-area of the product or a single operating step of the machine that produces such macro-area starts (or ends). This applies to every garment or product obtained.

Thus, continuing to generate said unique synchronization signal for every step for producing a macro-area of the product, the textile machine signals the repetition of the steps required for the complete production of a single product and thus the repetition of the production of several products to the control and interface unit 3.

More in particular, the unit 3 receives—through at least one connection line (electrical or serial) 10—data regarding the processing area (or what is indicated with MACHINE PROGRAM in FIG. 2 in column A), given that they are combined to the "OPERATING PROGRAM" (shown in column B of FIG. 2) associated to the article being produced or the regarding the specific programs or activations for each device; such data was previously saved in a memory present in the unit. As mentioned, such product actually provides for macro-areas (clearly identifiable portions of the product) obtained using different threads or with the same thread, but fed to the textile machine with different tension and/or speed so as to obtain said macro-areas with characteristics (for example resistance, compactness or aesthetic characteristics) peculiar of the adjacent macro-areas or product portions.

The programming of such data or operating program allows the unit 3 to set and control the operation of each single device 1 or 100 through specific methods which are as a function of the type of device and a function of the manufactured product, the production step thereof and the thread used for the production thereof. Such loading, for example occurs through a PC connected to the unit 3, through a USB flash drive, SDI cards, Ethernet connection, Wi-Fi connection or similar devices (identified—by way of example—by a block 11 in the figure).

The "operating program" provides for a table of the type indicated in FIG. 2. It is provided by an operator and provides for the division of the single production cycle of a product in different operating steps for the obtainment of different macro-areas of the product (for example a stocking: cuff, leg, ankle, heel, foot, tip) and the programming/activation of each device is defined for every operating macro-area. In the case in question, see FIG. 2, operating areas (ZERO, CUFF, LEG, HEEL, FOOT AND TIP) are provided corresponding to the aforementioned macro-areas of the product, two feeder devices (FEEDER_1 and FEEDER_2) and two sensors for controlling the presence of the yarn (SENSOR_1 and SENSOR_2). It should be observed that in the table of FIG. 2, to every operating area there corresponds a signal (generated by the machine) which, in the example, is a unique number for each operating area (shown in the MACHINE CODE column). For example, it is generated by four digital outfeeds (binary code), thus allowing the capacity to manage up to sixteen areas and an unlimited number of feeder devices 1 and sensors 100.

According to such division, the operating mode is defined for each device, i.e. each characteristic of each fed thread is defined, such as the operating tension, the speed thereof, as well as the enabling or disabling of each feeder 1 and the control parameters thereof, . . . .

Thus, the unit 3 drives and controls every device 1 as a function of the selected operating area of the machine (MACHINE CODE of table 2) according to the programming table.

Thus, the invention allows the operator to manage every device 1 or a plurality of devices in an extremely simple manner: actually, it is sufficient to fill the table of FIG. 2, specifying the behavior of the single device or a group of devices upon the variation of the operating areas indicated in column A of such figure. thus the unit 3 will program and manage the devices: for example, in the case of a feeder with constant tension, the control algorithm present in the unit 3 will manage the possible passage from one tension (and/or speed) to another exploiting the maximum resolution (or the minimum programmable tension) of the device to be managed.

The operator shall simply specify the need to pass, for example, from a 2 to 5 grams tension and it will be the control algorithm instead to decide the passage "ramp" from the first to the second tension depending on the type of controlled device. By using a unit 3 operating according to what is described, it becomes extremely simple for the operator to even intervene and modify the final result when defining the article. It will not be necessary to act on the machine program (column 2A of FIG. 2), but solely on the data of column 2B of such figure, memorized in the unit 3 and associated to the article being manufactured.

Thus, the unit 3 operates according to a method that provides for dividing the operating mode to obtain every product in a series of production steps corresponding to every product macro-area, said production steps being identified through unique synchronism or synchronization signals corresponding to each operating step of the machine or any area of the product being manufactured.

In other words, during the production of every macro-area or product portion (or operating area) corresponding to a specific operating step (or operating area) of the machine, the machine generates a corresponding synchronism or synchronization signal (shown in FIG. 2, column A through a MACHINE CODE 0-5). Such signal is received by the unit 3 which activates/deactivates each device by associating it to the corresponding process of the program (FIG. 2, column B).

Such operating condition for each device lasts until the machine generates another synchronism signal, corresponding to the production of a different product macro-area (or different operating area). This succession of steps continues until the product is completely obtained and then resumes from the step for obtaining the first product macro-area or first operating area, the one indicated with ZERO in the table of FIG. 2 and thus corresponds with start/end of a production cycle.

Thus, according to the invention, a unique synchronism signal that leads to programming and/or activating or deactivating every device 1 is detected for every specific operating step corresponding to a different macro-area of the product. Thus, the unit 3 sets and controls the operation of the latter and the mode of intervention thereof on the thread; thus, the unit 3 can manage every product production macro-area in a differentiated manner.

Thus, in the light of the above it is clear that the unit 3, operating according to the methods corresponding to the data contained in the table regarding every operating area, and knowing the operating step of the machine by analyzing the received synchronism signals, is capable of modifying the operating methods of each device as a function of the process progress status; as a matter of fact, the control unit 3 shall be solely be required to modify the operating methods thereof (for example by setting the operating tension for a feeder with constant tension) at each of such signals, for each connected device 1 or 100. If the modification is not possible, the unit 3 generates an alarm for the operator and stops the textile machine.

Given that the "operating program" (see the table of FIG. 2, column B) is the result of the data set in the unit 3 in a manner unconstrained from the textile machine 2 and the type of connected feeder 1 and/or sensor 100, it is clear that the operating data of the unit 3 can be set in a differentiated manner as a function of each type of device 1 or 100 or possible hardware/software version of the connected feeder device, thus allowing the yarn to continue developing the products thereof independently from the need to maintain compatibility with the particular textile machine to which they should be coupled or with other feeder devices connected to such machine.

In a more advanced version of the implementation of this method, besides generating a unique signal of each product macro-area, the machine can generate another synchronism signal (PRX) as a function of the position of an operating member of the machine textile machine such as, for example, of the cylinder of a circular machine or of the transmission shaft of a machine for preparing the yarn, in the operating step for the production of such macro-area. The algorithm could possibly use this information for managing a tension ramp or a tension modification mode/speed. For example, in the table of FIG. 2, column B, a request to pass from 2.0 grams (the tension present in the previous area) to 5.0 grams within 10 rotations of the cylinder is indicated by the operator in the CUFF area of FEEDER 1. Instead of being generated by the machine, the additional synchronism signal PRX could instead be retrieved from the machine through a proximity sensor capable of intercepting the rotation of the cylinder.

In any case, given that the steps not affected by the sizes of the article (or the cylinder rotations on a stocking manufacturing machine, for example) given that the synchronism or synchronization signals are each generated at the start (or at the end) of each product operating area (and they can even last over the entire work cycle), the feeding system and the method remain unvaried for every size of product obtained, where the transition of the operating step of each device 1 occurs for example as regards the tension with time ramps that may even be adjusted and programmed in each operating area (see FEEDER_2 in the LEG line of the table of FIG. 2) or with ramps as a function of the process progress state in the operating area through synchronism signals (PRX).

In particular, such devices may be of different type, same case applying to feeders with constant tension, of the positive or accumulation type, with fixed or rotary drum, feeders with constant sped, yarn detection sensors and quality control sensors. Such devices may also be one or more members that activate an operating function of the machine such as a solenoid valve, a waxing device, a cutter, an intertwining device.

In addition, in the operating area of each device (corresponding to an operating area of the machine) and for every operating step of the machine, besides the tension and/or thread feed speed there may also be associated the activation of special functions, such as for example the function of identifying any broken thread. Thus, in this case the broken thread function would be automatically enabled and disabled by the unit 3, at the operating area of the device 1, thus identifying the absence or breakage of the thread or utilization thereof in an undesired area.

The table of FIG. 2, column B, also shows the programming of a sensor for controlling the presence of the yarn, in which the sensitivity to be used for controlling the thread and whether the control should be active is selected as a function of the operating steps or areas of the machine.

The "operative program" can be optimized in terms of space (occupation of the memory), for example by indicating—for each operating area—the operations alone with respect to the previous operating area, or making each column (FEEDER 1) correspond not to a single device, but a group of devices that perform the same activity.

In a further alternative solution, the table for setting the tensions as a function of the process progress status could be contained in the memory of each device 1 and the synchronism signals could reach the device 1 directly or through the unit 3.

In another variant, the display and/or keypad 5 serves as control unit 3 and it is directly interfaced with the feeder devices 1 and receives the synchronism signals of the machine 2.

In a further variant of the invention, the display and/or keypad 5 is outside the control unit 3 or it is not there at all.

Lastly, according to a further variant, a first device 1 of the plurality of devices contains the unit 3, the other devices 1 of such plurality receiving the setting of such first device 1. In the mode in which the unit 3 also controls the operation of the of each feeder device, if it is contained in the first device 1 mentioned above, the latter drives and controls the operation of all the other feeder devices mounted on the machine.

The invention allows controlling the feeding of a thread to an operating machine obtained with a greater abstraction level with respect to that of the prior art and in particular that of WO2013/114174 and independent from the length of each operating area of the machine, thus allowing having a single Table for controlling such feeding upon the variation of the sizes, thus simplifying the programming of the devices.

The invention does not require knowing the length of each product macro-area and the corresponding operating area of the machine for the obtainment thereof for each size, due to the fact that the change from the operating area as a function of the macro-area occurs automatically as a function of the code of the operating area activated by the program of the machine. Thus, the change of size occurs automatically without requiring any selection by the operator, hence eliminating any risk of error.

Thus, in the machine program of any model/manufacturer, the operator shall solely be required to program a unique signal for every macro-area identical for any type of stocking/product and size.

Lastly, the memory consumption of the control means is considerably low.

The description regards an embodiment of the invention applied to a textile machine which operates on several threads fed by corresponding devices 1 and 100. However the invention also applies to the case of a machine that operates on only one thread which is processed using various methods in a production step such as of a twisting machine or any yarn preparation machine.

These variants shall also be deemed to fall within the scope of protection of the claims that follow.

The invention claimed is:

1. A method for managing and controlling feeding a thread-containing feedstock selected from a thread or yarn or a plurality of threads at constant tension and/or speed to an operating machine selected from a textile machine, a knitting machine, a stocking machine, a loom or a machine for preparing the yarn, the method comprising:

carrying out said feeding during:

production of a product from the thread-containing feedstock or processing of the thread-containing feedstock, wherein such production or processing comprises a succession of operating steps or operating areas defining a complete production cycle of the operating machine with respect to production of the product or processing of the thread-containing feedstock, wherein every single operating step or single operating area produces a product macro-area from the thread-containing feedstock or performs a single complete treatment of a plurality of treatments of the thread-containing feedstock, wherein said feeding of each thread-containing feedstock to said operating machine is by a corresponding feeder device, wherein said feeding is performed with at least one feature selected from:

the thread-containing feedstock being at constant tension, the thread-containing feedstock being at constant speed, and controlling the feeding by a sensor device which monitors the feeding or at least one characteristic of the thread-containing feedstock selected from thread tension, thread speed, thread diameter, fed thread quantity, thread color, and thread setting;

detecting said single operating step of the production cycle or said operating area of the operating machine or progress status of the production of the product through a synchronization signal generated by the operating machine, wherein the synchronization signal uniquely identifies the single operating step or single operating area through generation of a unique synchronization signal by the operating machine at a start or at an end of production of the product macro-area or the single complete treatment of the thread-containing feedstock;

associating particular set values of said at least one characteristic of the thread-containing feedstock fed by each feeder device to each of such operating steps or operating areas, said at least one characteristic being selected from the group consisting of thread tension, thread speed, thread diameter, fed thread quantity, and thread color, said set values being recorded in a table;

memorizing said particular set values in a setting and control means to which the feeder device and/or the sensor device is connected; and said setting and control means intervening on operation of the feeder device and/or the sensor device to define operating values of said at least one characteristic being selected from the group consisting of thread tension, the thread speed, the thread diameter, the fed thread quantity, and the thread color of the thread-containing feedstock corresponding to the particular set values memorized for producing said product macro-area of the product or for implementing the single complete treatment of the plurality of treatments to be carried out during processing of the thread-containing feedstock, said unique synchronization signal being used by said setting and control means for said intervening on operation of the feeder device and/or the sensor device to control and/or feed the thread with the operating characteristics suitable to implement said single operating step or said single operating area to obtain, respectively, said product macro-area or to carry out said single complete treatment of the plurality of treatments to be carried out during processing of the thread-containing feedstock, said setting and control means uniquely identifying said single operating step or said single operating area according to the unique synchronization signal received from the operating machine, wherein the single operating step or the single operating area to obtain the product macro-area or the single treatment, respectively, is carried out according to the particular set values of said at least one characteristic of the thread for each of the single operating steps or the single operating areas.

2. The method according to claim 1, wherein said setting and control means detects corresponding current actual values of the characteristic of the thread fed to the textile machine by each feeder device, and compares said current actual values with the particular set values, generating a warning to the operator, stopping the textile machine, or requiring intervention on each feeder device, should there be detected a difference between actual or current values and the set values.

3. The method according to claim 1, associating data regarding the characteristics of the thread-containing feedstock fed to the operating machine to the synchronization signal, which uniquely identifies the operating step or single operating area, the setting and control means acting on said feeder device and/or sensor device to adapt every controlled characteristic of the thread to every single operating step or single operating area based on the synchronization signal and data associated to the respective synchronization signal.

4. The method according to claim 1, wherein the unique synchronization signal corresponds to a particular operating step or a particular operating area to which a plurality of data regarding feeding and/or control of the thread and the characteristics is associated.

5. The method according to claim 1, wherein the unique synchronization signal is defined by a logic level, or one or more pulses, or one or more digital signals, or a variable duty cycle signal, or an analogue signal or a serial communication.

6. The method according to claim 1, wherein, besides the unique synchronization signal defining each single operating step or single operating area, the textile machine may transmit to the control and setting means a further synchronization signal that is dependent on a position of an operating member of the textile machine during the particular single operating step or single operating area.

7. The method according to claim 6, wherein said setting and control means alternatively use the further synchronization signal or a time programmable range in each single operating step or single operating area to manage an automatic tension ramp or a delay of the control step of one of the characteristics of the thread.

8. The system for managing and controlling the feeding of a thread-containing feedstock selected from a thread or yarn or a plurality of threads with constant tension and/or speed to an operating machine selected from a textile machine, a knitting machine, a stocking machine, loom or a machine for preparing the yarn, said system operating according to the method according to claim 1, said feeding being carried out during production of a product from the thread-containing feedstock or processing of the thread-containing feedstock, such production or processing comprising a succession of operating steps or operating areas defining a complete production cycle of the operating machine with respect to production of the product or processing of the thread-containing feedstock, wherein every single operating step or single operating area produces a product macro-area from the thread-containing feedstock or performs a single complete treatment of a plurality of treatments of the thread-containing feedstock, the system comprising a feeder device feeding a corresponding said thread-containing feedstock to said operating machine with at least one feature selected from:

the thread-containing feedstock being at constant tension, the thread-containing feedstock being at constant speed, and a sensor device being provided to monitor the feeding or at least one characteristic selected from thread tension, thread speed, thread diameter, fed thread quantity, thread color, and thread setting, a setting and control means connected to such feeder device and/or sensor device being provided to set and control the operation thereof, said setting and control means receiving synchronization signals from the operating machine, wherein the synchronization signals correspond to the start and end of each operating cycle or operating area, said synchronization signals being suitable to allow the production of a product macro-area or the obtainment of a single complete treatment of a plurality of treatments to which the thread should be subjected, each single synchronization signal uniquely corresponding to each of a plurality of operating steps or operating areas of the operating machine to produce a product macro-area or implement said single complete treatment of the thread, the sum of such operating steps corresponding to the production of a complete product or the implementation of a complete treatment of the thread-containing feedstock, the setting and control means being suitable to act on said feeder device and/or sensor device according to each of said synchronization signals received from the machine so that such feeder device or sensor device feeds and/or controls the respective thread-containing feedstock with predefined and peculiar tension and/or speed of each of such operating steps or operating areas, values of the at least one characteristic of the fed thread-containing feedstock by each feeder device being set for each aforementioned operating step or operating area, said characteristic comprising at least one characteristic selected from thread tension, thread speed, thread diameter, thread quantity, and thread color, said set values of each characteristic of the fed thread-containing feedstock being memorized in said setting and control means.

9. The system according to claim 8, wherein the setting and control means are a drive and control interface unit interposed between each feeder device and/or sensor device and the textile machine, said drive and control interface unit being programmable.

10. The system according to claim 9, wherein each of the feeder devices and/or sensor devices is connected to the drive and control interface unit alternatively through one of the following methods:

serial communication, electrical signals adapted to recognize hardware controls generated by the drive and control interface unit.

11. The system according to claim 9, wherein said drive and control interface unit is part of a device for feeding the plurality of feeder devices.

12. The system according to claim 8, wherein said feeder devices are configured for feeding the thread with constant tension, also comprising accumulation feeders with fixed or rotary drum, yarn feeding detector devices, devices for controlling tension or speed or quantity of the thread fed to the textile machine, and/or devices for acting on the thread such as cutters or operator members of the textile machine.

13. The system according to claim 8, wherein the synchronization signal is alternatively a signal characterized by a logic level, or by one or more pulses, or by one or more binary code digital signals or by a variable duty cycle signal, or by an analogue signal, or by a serial communication.

14. Method according to claim 1, wherein said characteristic being selected from among said characteristics thereof, said particular set values being recorded in the table.

15. The method according to claim 1, wherein, besides the unique synchronization signal defining each operating step or operating area, the textile machine transmits to the control and setting means a further synchronization signal in the single operating step or single operating area, the further synchronization signal being dependent on a position of an operating member of the textile machine selected from at least one of a rotary cylinder of a circular machine or a transmission shaft of a machine for preparing the yarn.

16. The system according to claim 8, wherein each single feeder device and/or sensor device is connected to the interface and control unit alternatively through one of the following methods:

serial communication, electrical signals adapted to recognize hardware controls generated by the aforementioned unit selected from INC, DEC, and enabling/disabling the signals.

17. The method according to claim 1, wherein said feeding is performed with at least one feature selected from:

the thread-containing feedstock being at constant tension and the thread-containing feedstock being at constant speed.

18. The method according to claim 1, wherein the feeding is controlling by a sensor device which monitors the feeding or at least one characteristic of the thread-containing feedstock selected from thread tension, thread speed, thread diameter, fed thread quantity, thread color, and thread setting.

19. The system according to claim 8, wherein the sensor device is provided to monitor the feeding or at least one characteristic selected from thread tension, thread speed, thread diameter, thread quantity, thread color, and thread setting.

* * * * *